US009126344B2

(12) United States Patent
Grisoni

(10) Patent No.: US 9,126,344 B2
(45) Date of Patent: Sep. 8, 2015

(54) PRECISION TOOL AND PROCESS FOR MAKING THE SAME

(75) Inventor: Sandro Grisoni, Balerna (CH)

(73) Assignee: IDEAL-TEK SA, Balerna (CH)

( * ) Notice: Subject to any disclaimer, the term of this patent is extended or adjusted under 35 U.S.C. 154(b) by 448 days.

(21) Appl. No.: 13/426,668

(22) Filed: Mar. 22, 2012

(65) Prior Publication Data

US 2012/0266467 A1 Oct. 25, 2012

Related U.S. Application Data

(60) Provisional application No. 61/468,185, filed on Mar. 28, 2011.

(30) Foreign Application Priority Data

Mar. 23, 2011 (CH) ..... 0508/11

(51) Int. Cl.

| | |
|---|---|
| ***B26B 15/00*** | (2006.01) |
| ***B26B 17/00*** | (2006.01) |
| ***B25B 7/04*** | (2006.01) |
| ***B26B 13/04*** | (2006.01) |

(52) U.S. Cl.

CPC . *B26B 17/00* (2013.01); *B25B 7/04* (2013.01); *B26B 13/04* (2013.01); *Y10T 29/49947* (2015.01)

(58) Field of Classification Search

USPC ..... 30/176, 175, 177, 186, 349, 191, 192, 30/193; 140/123; 81/421, 423, 422, 415, 81/416

See application file for complete search history.

(56) References Cited

U.S. PATENT DOCUMENTS

| | | | | |
|---|---|---|---|---|
| 496,584 | A * | 5/1893 | Taft | 30/186 |
| 1,168,051 | A * | 1/1916 | Bernard | 30/186 |
| 1,181,871 | A * | 5/1916 | Graham | 30/349 |
| 1,405,028 | A * | 1/1922 | Stead | 81/3.6 |
| 1,662,108 | A * | 3/1928 | Fay | 30/193 |
| 2,677,177 | A * | 5/1954 | Herckelbout | 30/191 |
| 4,130,938 | A * | 12/1978 | Uhlmann | 30/192 |
| 5,987,752 | A * | 11/1999 | Swanstrom, Jr. | 30/186 |
| 2011/0289784 | A1 * | 12/2011 | Jones | 30/175 |

* cited by examiner

*Primary Examiner* — Omar Flores Sanchez
(74) *Attorney, Agent, or Firm* — Young & Thompson

(57) ABSTRACT

Precision tool and process for making the same. The tool includes two prongs adapted to be associated with each other. Each prong (2, 2') including a grip portion (4, 4') and a cutting or bending portion (5, 5'). Each prong (2, 2') is associated with the other prong so as to move the cutting or bending portion from a working position, in which the cutting or bending portions (5, 5') contact each other, to a rest position, in which the cutting or bending portions are spaced apart from each other at at least one section thereof. Each cutting or bending portion includes at least one support portion (3, 3') and at least one operating portion (7, 7'). Each operating portion includes at least one cutting blade or bending portion. Coupling elements are present for removably coupling at least one operating portion with at least one support portion.

11 Claims, 5 Drawing Sheets

PRECISION TOOL AND PROCESS FOR MAKING THE SAME

FIELD OF THE INVENTION

The present invention relates to a precision tool and particularly to precision cutting nippers and to a process for making the same.

PRIOR ART

Precision tools and particularly precision cutting nippers and pliers are generally intended for particular application fields, such as horology, electronics, jewelry, medicine, where it is often required to be able to handle and cut wires which may be very thin—e. g. of the size of a human hair or smaller—with a very high quality of the cut, which substantially does not leave marks on the sheared surface.

The precision degree of these cutting nippers may be for example determined by the rake and, based on the cutting precision, is usually identified by three different designations, which correspond to three different cutting precisions, namely flush, semi-flush and ultra-flush.

The tool portion intended for cutting is made of a special material, such as a hard material, e.g. widia, also known as cemented carbide.

The Applicant has observed that, because of the costs, in the known systems only the tool portion intended for cutting is made of a special material, whereas the remaining portion is made of a less expensive material. The two portions are joined together by means of braze welding, after which the blades are sharpened by grinding for obtaining the quality and cutting precision desired for the tool.

The Applicant has further observed that the braze welding operation deserves great care and any error, even minimal, in this operation results in a not perfect alignment of the tool blades and thus in an item to be scrapped.

The Applicant has further observed that the braze welding is time-consuming and expensive.

Finally, the Applicant has noticed that any defect or fracture that arises in any of the tool portions, either after the braze welding or sharpening operations or in use, causes the whole tool to be scrapped.

SUMMARY OF THE INVENTION

The Applicant has found that it is possible to overcome the abovementioned problems with a precision tool in which the braze welding operation for coupling the two tool portions can be avoided and the critical aspects of the sharpening operation can be limited.

In a first aspect thereof, the invention thus relates to a precision tool comprising two prongs adapted to be associated with each other;

- each prong comprising a grip portion and a cutting or bending portion;
- each prong being associated with the other prong by means of a precision member, comprising at least one screw-nut system, so as to move the cutting or bending portion from a working position, in which the cutting o bending portions contact each other, to a rest position, in which the cutting or bending portions are spaced apart from each other at at least one section thereof;
- each cutting or bending portion comprising at least one support portion and at least one operating portion;
- each operating portion comprising at least one cutting or bending blade;

characterized by comprising coupling means for removably coupling at least one operating portion with at least one support portion.

The precision cutting nippers and pliers are made with a precision approaching $^{5}/_{1000}$ of a millimeter.

The tight tolerances required in the manufacture of the tool are an essential condition for the proper operation of the same.

The dimensional accuracy in the construction and in the manufacturing process allows the tool to be defined as a "precision tool".

The particular application fields, such as horology, electronics, jewelry and medicine, in which the cutting nippers and/or pliers are used involve geometric, functional and efficiency constraints which only precision tools meeting the above definitions can satisfy.

Within the framework of the present invention, by the expression precision tool it is defined, referring to FIG. 5, a tool in which:

- the main cutting edges 30, i.e. the axially outermost cutting edges, define a rake angle $\beta$ smaller than 40° relative to the axially outer ground plane 32;
- the secondary cutting edges 31, i.e. the axially innermost cutting edges, define a rake angle $\alpha$ smaller than 60° relative to the axially outer ground plane 32;
- the main cutting edges 30 facing each other define a maximum distance D smaller than 0.8 mm, D being measured perpendicularly to the axial direction substantially at the point where the main cutting edge itself joins the axially outer ground plane;
- the main cutting edges 30 facing each other define a maximum height h smaller than 0.25 mm.

The present invention, in the abovementioned aspect, may have at least one of the preferred features which are hereinafter described.

Conveniently, the screw-nut system comprises at least one screw and at least one calibrated nut and is adapted to generate a predetermined friction and a substantially constant movement while the cutting or bending portion moves from the working position to the rest position and vice versa.

Preferably, the coupling means comprise at least one clamp screw and at least one threaded seat for receiving the clamp screw.

Advantageously, the threaded seat is formed on the support portion.

Preferably, the coupling means comprise a self-centering device.

Advantageously, the self-centering device is shaped so as to lock into position the operating portion relative to the support portion along three mutually orthogonal directions, when such portions are assembled with each other.

Conveniently, the self-centering device comprises at least one tapered portion formed on the operating portion adapted to mate with a corresponding tapered portion formed on the support portion.

Advantageously, the self-centering device comprises a shoulder, extending substantially at a right angle, formed on the operating portion, and a head element, formed on one end of the support portion; said head element being dimensioned and shaped so as to abut against the shoulder, when the operating portion is coupled with the support portion.

Preferably, the shoulder and the head element are flat.

Conveniently, the operating portion is made of cemented carbide.

According to another aspect, the present invention relates to a process for making a precision tool of the type comprising two prongs adapted to be associated with each other;

each prong comprising a grip portion and a cutting portion;

each prong being associated with the other prong so as to move the cutting or bending portion from a working position, in which the cutting portions contact each other, to a rest position, in which the cutting portions are spaced apart from each other at at least one section thereof;

each cutting portion comprising at least one support portion and at least one operating portion;

each operating portion comprising at least one cutting blade;

the process comprising the following steps:

making two prongs;

making to operating portions;

grinding and sharpening the said two operating portions;

providing coupling means;

removably coupling the two operating portions with the two prongs by means of said coupling means.

Preferably, the step of grinding and sharpening the said two operating portions is carried out before the step of removably coupling the two operating portions with the two prongs by means of the said coupling means.

BRIEF DESCRIPTION OF THE DRAWINGS

Further features and advantages of the invention shall become more apparent from the detailed description of some preferred, although not exclusive, embodiments of a precision tool according to the present invention.

Such description shall be presented hereinafter with reference to the accompanying drawings, provided only for indicating, and thus non-limiting, purposes, wherein.

DETAILED DESCRIPTION OF EMBODIMENTS OF THE INVENTION

Figure 1:
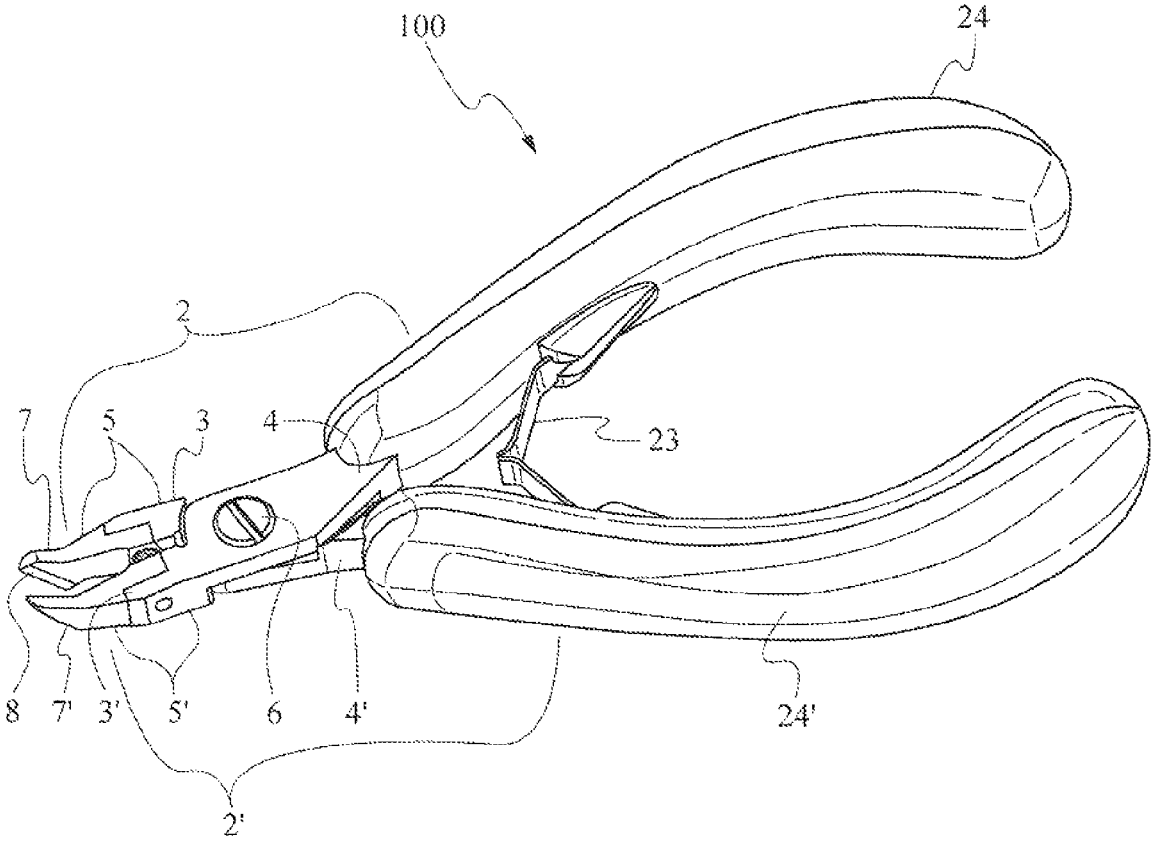
FIG. 1 is a schematic side view of an embodiment of a precision cutting tool according to the present invention.
Figure 2:
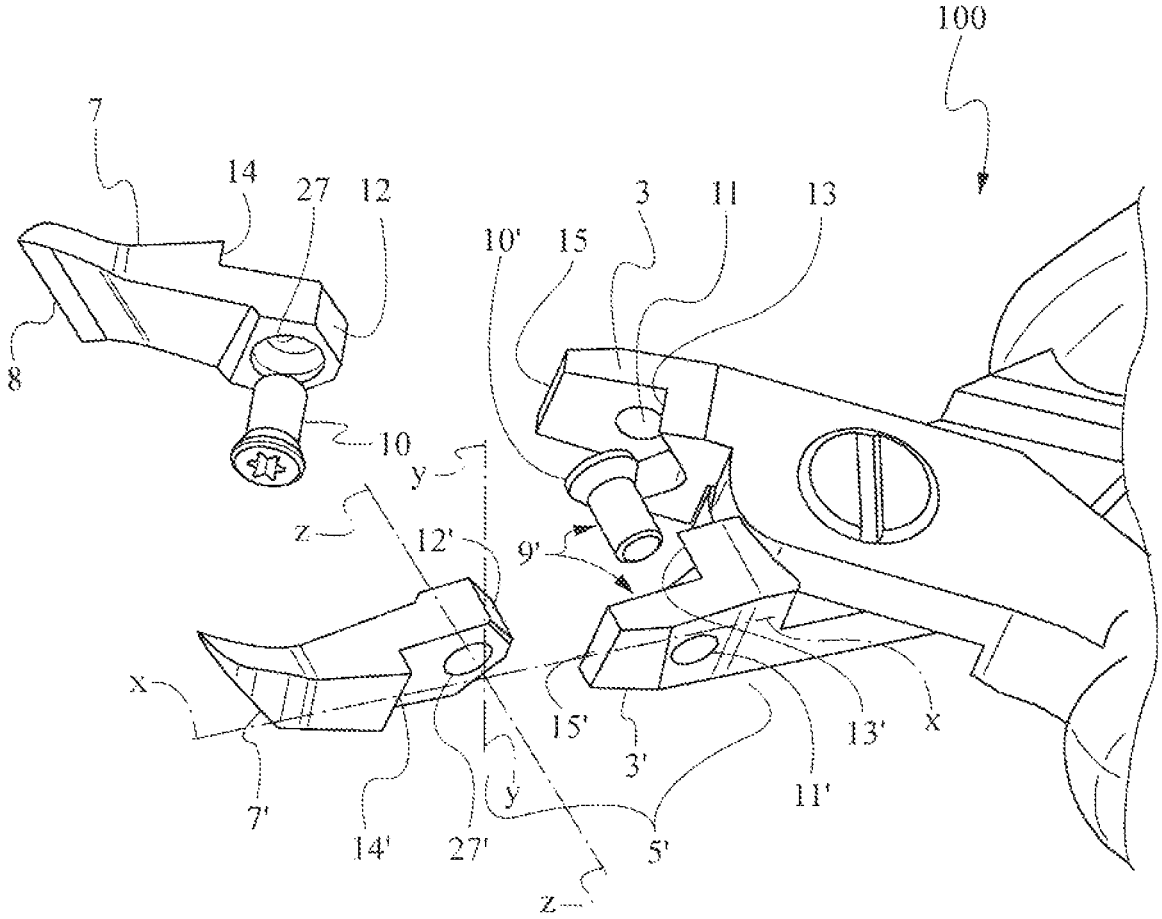
FIG. 2 is a view of the partially disassembled cutting portion of the precision tool according to the present invention shown in FIG. 1.
Figure 3:
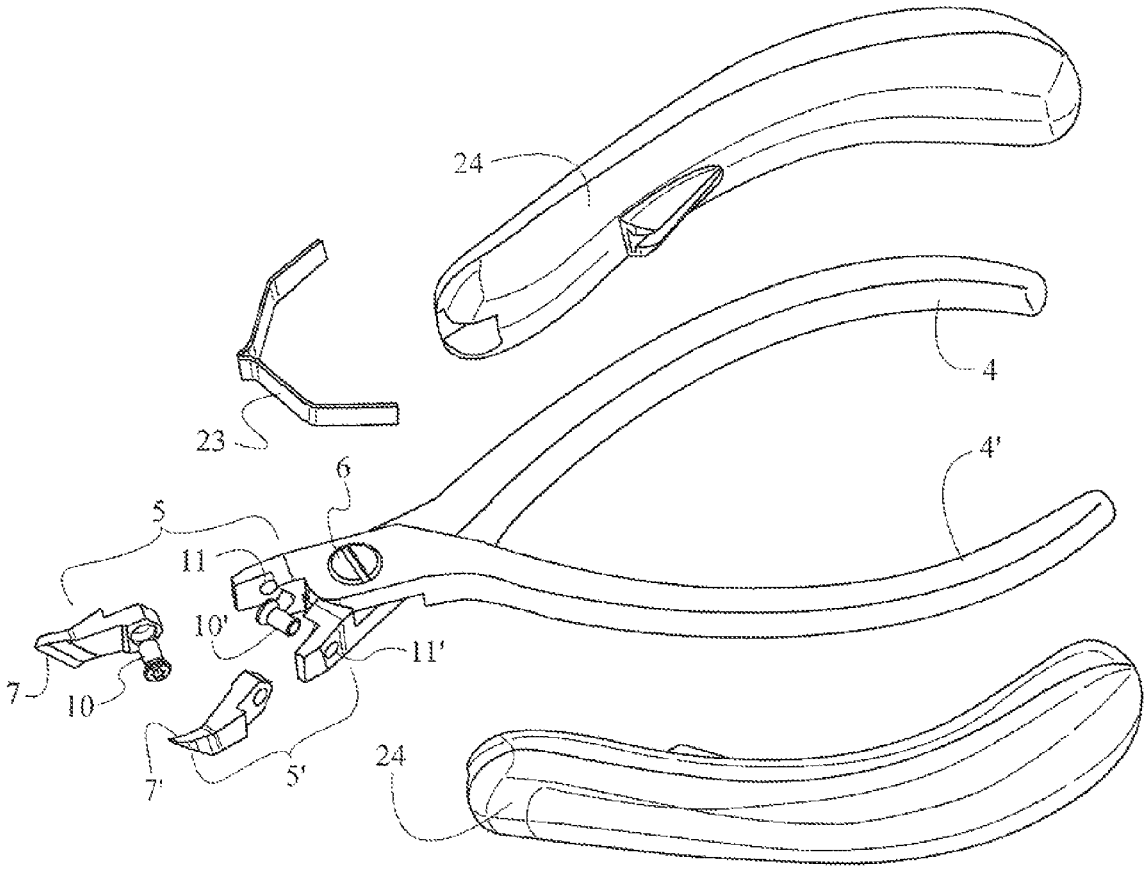
FIG. 3 is a schematic exploded view of an embodiment of a precision cutting tool according to the present invention.

Referring to FIGS. 1-3, a precision tool, particularly a cutting tool, according to the present invention is identified by reference numeral 100.

In particular, the cutting tool 100 is provided with two prongs 2, 2' adapted to be associated with each other, by means of a precision member 6.

Each prong 2, 2' comprises a grip portion 4, 4' and a cutting portion 5, 5'.

Each prong 2, 2' is associated, by means of a precision member 6, with the other prong.

The precision member is a screw-nut system adapted to generate a predetermined friction and a substantially constant movement while the cutting portion moves from the working position to the rest position and vice versa.

The precision member 6 comprises a slotted screw of the torx type and a calibrated nut.

The precision member 6 separates and defines the grip portion 4, 4' and the cutting or bending portion 5, 5' in each prong 2, 2'.

Each prong 2, 2' is associated, by means of the precision member 6, with the other prong so as to move the cutting portions 5, 5' from a working position, in which the cutting portions 5, 5' contact each other, to a rest position (shown in FIG. 1), in which the cutting portions (5, 5'), or a section thereof, are spaced apart from each other.

As better shown in FIG. 2, each cutting portion 5, 5' has at least one support portion 3, 3' and at least one operating portion 7, 7'.

Each operating portion 7, 7' comprises at least one cutting blade or cutting edge 8, 8', i.e. the tool portion adapted to interact with the material to be cut.

Figure 5:
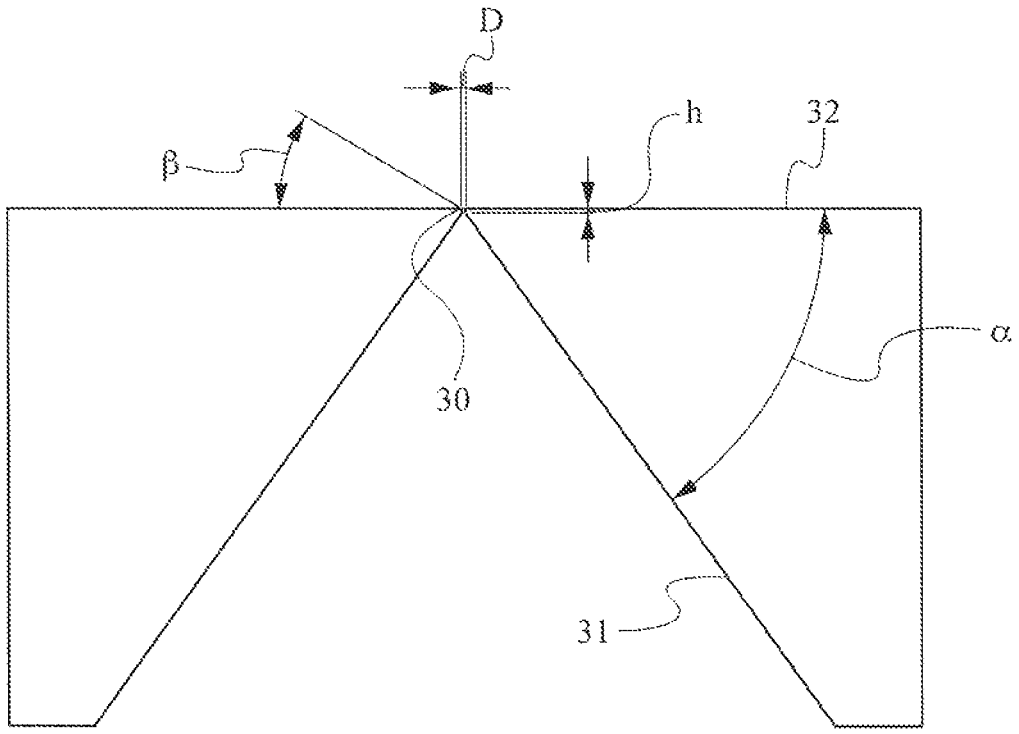
FIG. 5 is a schematic view of the rack angles adapted to define a precision tool according to the present invention.

Within the framework of the present invention, by the expression precision tool it is defined, referring to FIG. 5, a tool in which:

the main cutting edges 30, i.e. the axially outermost cutting edges, define a rake angle $\beta$ smaller than 40° relative to the axially outer ground plane 32;

the secondary cutting edges 31, i.e. the axially innermost cutting edges, define a rake angle $\alpha$ smaller than 60° relative to the axially outer ground plane 32;

the main cutting edges 30 facing each other define a maximum distance D smaller than 0.8 mm, D being measured perpendicularly to the axial direction substantially at the point where the main cutting edge itself joins the axially outer ground plane;

the main cutting edges 30 facing each other define a maximum height h smaller than 0.25 mm.

Preferably, the operating portion is made of a special material such as for example widia, also known as cemented carbide, carboloy or hard metal.

Cemented carbide or widia is used in machining and consists of hard particles of tungsten carbide embedded in a metal matrix. Generally, the cemented carbide or widia is made by means of a sintering process, in which, as it is known, fine powders and components are mixed, pressed and then heated in a vacuum furnace at temperatures between 1300° and 1600° C. In the furnace a high pressure is maintained, so that the powder grains aggregate to form an integral piece. The sintering process make the tungsten carbide and the cobalt (matrix) to melt together, producing a dense "hard metal".

After sintering the strength of the material is such that only diamond machining—a special micro-machining operation which is relatively expensive, since it does not allow to remove large amounts of material—is possible. Widia is used for making tools to be used for applications which require a high hardness material (cutting, crumbling, etc.). Tools made of hard metal or widia have a higher hardness compared to those made of high-speed steel (HV 1500 instead of HV 1000) and withstand higher cutting temperatures (1000° C. instead of 600° C.).

According to an important aspect of the present invention, the tool 100 has coupling means 9 for removably coupling at least one operating portion 7, 7' with at least one support portion 3, 3'.

An operating portion 7, 7' is removably coupled with a support portion 3, 3'.

Preferably, the coupling means 9 comprise at least one clamp screw 10, 10' and at least one threaded seat 11, 11' for receiving the clamp screw 10, 10'.

This allows the braze welding operation which is performed in the known precision tools to be avoided and the sharpening operation by means of grinding to be performed before assembling.

Referring to the embodiment of FIGS. 1-3, the threaded seat 11, 11' for receiving the clamp screw 10, 10' is formed on the support portion 3, 3', whereas the calibrated through seat 27, 27' is made on each operating portion 7, 7'.

Preferably, the screw is a slotted screw of the torx type.

This choice ensures a greater precision compared to a different coupling system and a large clamp torque.

For obtaining a precise coupling between operating portion and support portion, the precision cutting tool 100 has a self-centering device.

The self-centering device is shaped so as to lock into position the operating portion 7, 7' relative to the support portion 3, 3' along three mutually orthogonal directions, as indicated by axes X-X; Y-Y; Z-Z in the figure.

Referring to the embodiment shown in FIGS. 1-3, the self-centering device is represented by at least one tapered portion 12, 12' formed on the operating portion 7, 7' and by a corresponding tapered portion 13, 13' formed on the support portion 3, 3'.

In the embodiment shown in the figures the tapered portion 12, 12' has a substantially triangular shape, while the corresponding tapered portion 13, 13' formed on the support portion 3, 3' has a dovetail shape, in other words it reproduces in negative the triangular shape of the tapered portion 12, 12'.

The tapered portion 12, 12' is dimensioned and shaped for coupling substantially perfectly with the corresponding tapered portion 13, 13' formed on the support portion 3, 3'.

Referring to the embodiment shown in FIGS. 2-3, each tapered portion is defined by two substantially flat, converging surfaces adapted to abut against two substantially flat converging surfaces, each defining a corresponding tapered portion 13, 13' formed on the support portion 3, 3'.

Referring to FIG. 2, the engagement of the substantially flat surfaces of each tapered portion 12, 12' with the related flat surfaces of the respective corresponding tapered portion 13, 13' formed on the support portion 3, 3' prevents a movement along the Y-Y direction of each operating portion 7, 7' relative to the support portion with which it is associated.

The portions 12, 12' and thus the portions 13, 13' could also have other shapes without departing from the scope of protection of the invention.

The tapered portions 12, 12' as well as the corresponding tapered portions 13, 13' are ground by means of hi-speed Haas milling machines with precisions approaching 5/1000 of a millimeter.

In order to further increase the precision of the coupling between operating portion 7, 7' and support portion 3, 3', the self-centering device comprises a shoulder 14, 14' extending substantially at a right angle, formed on the operating portion 7, 7', and a head element 15, 15' formed on one end of said support portion 3, 3'.

Each head element 15, 15' is dimensioned and shaped so as to abut against a shoulder 14, 14' when the operating portion 7, 7' is coupled with the support portion 3, 3'.

Preferably, the shoulders 14, 14' and the head elements 15, 15' are flat.

Still referring to FIG. 2, the mating of the shoulder 14, 14' with the shoulder elements 15, 15' prevents a movement along the Y-Y direction of each operating portion 7, 7' relative to the support portion 3, 3' with which it is associated.

The shoulders 14, 14' are ground by means of numerical control sharpening machines especially intended for hard metal machining and the head elements 15, 15' are as well machined by means of hi-speed Haas milling machines with precisions approaching 5/1000 of a millimeter.

In a coupled condition each operating portion 7, 7' is partially facing and superimposed to the respective support portion 3, 3'; this kind of coupling prevents a movement of the components with respect to the Z-Z axis, i.e., referring to FIG. 2, an axis coming out of the page and orthogonal to the X-X and Y-Y axes.

Figure 4:
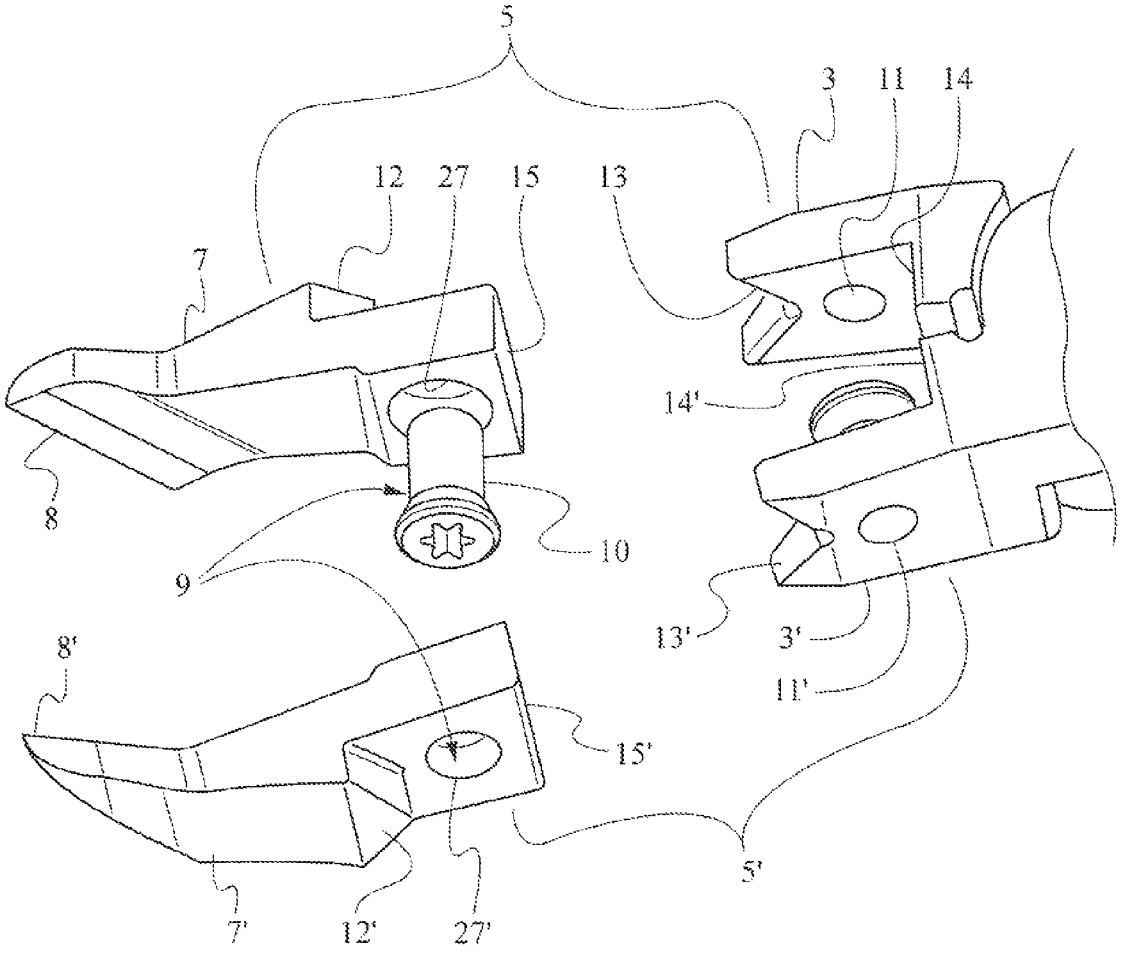
FIG. 4 is a schematic view of an alternative embodiment of the cutting portion of the precision tool.

In FIG. 4 an alternative embodiment of the tool according to the present invention is shown in which the mutual position on the operating portion 7, 7' and on the support portion 3, 3' of the tapered portions 12, 12' and 13, 13' relative to the shoulder 14, 14' or the head elements 15, 15' is modified.

In detail, on each operating portion 7, 7' the position of the tapered portion 12, 12' is swapped with the position of the head elements 15, 15' so that the head elements 15, 15' are moved to an inner position and the tapered portions 12, 12' are moved to a more outer position.

Similarly, on each support portion 3, 3' the position of the tapered portion 13, 13' is swapped with the position of the shoulder 14, 14' so that the latter are moved to an inner position and the tapered portions 13, 13' are moved to a more outer position.

Referring to the embodiment shown in FIGS. 1-3, it can be seen that the tool has two ergonomic handles 24, each adapted to be mounted on one of the prongs 2, 2', and a spacing flat spring 23 adapted to be interposed between the two prongs 2, 2' for holding the cutting or bending portions 5, 5' in the rest position.

The process for making a precision tool according to the present invention comprises the steps of:

making two prongs 2, 2';

making two operating portions 7, 7';

grinding and sharpening the blades 8, 8' of the two operating portions 7, 7';

providing coupling means 9;

removably assembling the two operating portions with the two prongs 2, 2' by means of said coupling means 9.

The assembling step is carried out by introducing the clamp screws 10, 10' in the suitable threaded seats 11, 11' so as to associate an operating portion 7, 7' with the respective support portion 3, 3'.

In detail, according to a particularly advantageous aspect of the present invention, the step of sharpening the blades 8 of the two operating portions is carried out before the step of removably coupling the two operating portions 7, 7' with the two prongs 2, 2' by means of the coupling means 9.

The present invention has been described with reference to some embodiments thereof. Many modifications can be introduced in the embodiments described in detail, still remaining within the scope of protection of the invention, which is defined by the appended claims.

The invention claimed is:

1. Process for making a precision tool comprising two prongs (2, 2') adapted to be associated with each other;

each of said prongs (2, 2') comprising a grip portion (4, 4') and a cutting or bending portion (5, 5');

each of said prongs (2, 2') being associated with the other of said two prongs, wherein the cutting or bending portion (5, 5') is movable from a working position, in which the cutting or bending portions (5, 5') contact each other, to a rest position, in which the cutting or bending portions (5, 5') are spaced apart from each other at least one section thereof;

each said cutting or bending portion (5, 5') comprising at least one support portion (3, 3') and at least one operating portion (7, 7');

each operating portion (7, 7') comprising at least one cutting blade;

the process comprising the following steps:

making the two prongs (2, 2');

making two of the operating portions (7, 7');

grinding and sharpening said two operating portions (7, 7');

removably coupling the two operating portions to the two prongs with respective clamp screws (10, 10'), wherein the two operating portions are self-centered on the respective said support portion by operation of a self-centering device comprised of (a) a planar exterior surface (14, 14') of each said operating portion (7, 7') and a respective mating planar exterior surface (15, 15') of each said support portion (3, 3') and (b) a protruding V-shaped exterior surface (12, 12') of each said operating portion (7, 7') and a respective mating recessed V-shaped exterior surface (13, 13') of each said support portion (3, 3'), wherein the planar exterior surface and the protruding V-shaped exterior surface of each said operating portion (7, 7') are spaced from each other and intersect a first surface of said operating portion and wherein the respective mating planar exterior surface and the respective mating recessed V-shaped exterior surface of each said support portion (3, 3') are spaced from each other and intersect a first surface of said support portion, and wherein each of said clamp screws extends through respective said first surfaces of said operating portion and support portion and immobilizes the planar exterior surface of one said operating portion directly abutting the planar exterior surface of one said support portion, immobilizes the first surface of said one operating portion directly abutting the first surface of said one support portion, and immobilizes said protruding V-shaped exterior surface of said one operating portion directly abutting said recessed V-shaped exterior surface of said one support portion.

2. The process for making a precision tool according to claim 1, wherein said step of sharpening said two operating portions (7, 7') is carried out before the step of removably coupling the two operating portions (7, 7') to the two prongs (2, 2').

3. The process according to claim 1, wherein the planar exterior surface and two adjoining surfaces defining the protruding V-shaped exterior surface of each said operating portion are each transverse to each other so that extensions thereof form a triangle.

4. The process according to claim 1, wherein said protruding and recessed V-shaped surfaces and said planar exterior surfaces are each ground by high speed Haas milling machines with a precision approaching 5/1000 of a millimeter.

5. A precision tool comprising:

two prongs (2, 2') adapted to be associated with each other;

each of said prongs (2, 2') comprising a grip portion (4, 4') and a cutting or bending portion (5, 5');

each of said prongs (2, 2') being associated with the other one of said prongs by a precision member (6) comprising at least one screw-nut system, wherein the cutting or bending portion (5, 5') is movable from a working position, in which the cutting or bending portions (5, 5') contact each other, to a rest position, in which the cutting or bending portions (5, 5') are spaced apart from each other at at least one section thereof;

each said cutting or bending portion (5, 5') comprising a support portion (3, 3') and an operating portion (7, 7') that are removably coupled to each other by a clamp screw (10, 10');

each said operating portion (7, 7') comprising at least one cutting or bending blade; and wherein each said operating portion is self-centered on a respective said support portion with a self-centering device comprised of (a) a planar exterior surface (14, 14') of each said operating portion (7, 7') and a respective mating planar exterior surface (15, 15') of each said support portion (3, 3') and (b) a protruding V-shaped exterior surface (12, 12') of each said operating portion (7, 7') and a respective mating recessed V-shaped exterior surface (13, 13') of each said support portion (3, 3'), wherein the planar exterior surface and the protruding V-shaped exterior surface of each said operating portion (7, 7') are spaced from each other and intersect a first surface of said operating portion and wherein the respective mating planar exterior surface and the respective mating recessed V-shaped exterior surface of each said support portion (3, 3') are spaced from each other and intersect a first surface of said support portion, and wherein each said clamp screw extends through respective said first surfaces of said operating portion and support portion and immobilizes the planar exterior surface of one said operating portion directly abutting the planar exterior surface of one said support portion, immobilizes the first surface of said one operating portion directly abutting the first surface of said one support portion, and immobilizes said protruding V-shaped exterior surface of said one operating portion directly abutting said recessed V-shaped exterior surface of said one support portion.

6. The precision tool (100) according to claim 5, wherein said screw-nut system comprises at least one screw and at least one threaded nut and is adapted to generate a predetermined friction and a substantially constant movement while the cutting portion (5, 5') moves from the working position to the rest position and vice versa.

7. The precision tool (100) according to claim 5, further comprising a threaded seat (11, 11') for receiving said clamp screw (10, 10').

8. The precision tool according to claim 7, wherein said threaded seat (11, 11') is on the said support portion (3, 3').

9. The precision tool according to claim 5, wherein said operating portion (7, 7') is made of cemented carbide.

10. The precision tool according to claim 5, wherein the planar exterior surface and two adjoining surfaces defining the protruding V-shaped exterior surface of each said operating portion are each transverse to each other so that extensions thereof form a triangle.

11. The precision tool according to claim 5, wherein each said cutting or bending blade has a main cutting edge (30) with a rake angle ($\beta$) smaller than 40° relative to an axially outer ground plane (32), and a secondary cutting edge (31) with a rake angle ($\alpha$) smaller than 60° relative to the axially outer ground plane (32), wherein the main cutting edges (30) facing each other define a distance (D) therebetween that is smaller than 0.8 mm and define a height (h) difference smaller than 0.25 mm.

* * * * *